US005825304A

United States Patent [19]

Marin

[11] Patent Number: 5,825,304

[45] Date of Patent: Oct. 20, 1998

[54] EMERGENCY VEHICLE PROXIMITY WARNING AND COMMUNICATION SYSTEM

[76] Inventor: Renzo T. Marin, 25 Semrado Rancho, Santa Margarita, Calif. 92688

[21] Appl. No.: 716,856

[22] Filed: Sep. 18, 1996

[51] Int. Cl.[6] ..... G08G 1/16

[52] U.S. Cl. ..... 340/903; 340/902; 340/825.72; 342/455

[58] Field of Search ..... 340/901, 902, 340/903, 904, 825.72, 825.32, 825.36; 364/424.045, 424.055; 342/455

[56] References Cited

U.S. PATENT DOCUMENTS

| | | | |
|---|---|---|---|
| 3,233,217 | 2/1966 | Bost, Jr. | 340/901 |
| 3,673,560 | 6/1972 | Barsh et al. | 340/902 |
| 3,760,349 | 9/1973 | Keister et al. | 340/902 |
| 3,858,091 | 12/1974 | Wilkinson | 361/724 |
| 3,873,963 | 3/1975 | Neal et al. | 340/902 |
| 3,876,940 | 4/1975 | Wickord et al. | 340/902 |
| 4,225,821 | 9/1980 | Carleson | 455/73 |
| 4,398,172 | 8/1983 | Carroll et al. | 455/604 |
| 4,403,208 | 9/1983 | Hodgson et al. | 340/902 |
| 4,794,394 | 12/1988 | Halstead | 340/902 |

*Primary Examiner*—Jeffery Hofsass
*Assistant Examiner*—Ashok Mannava

[57] ABSTRACT

An emergency vehicle proximity warning and communication system including a transmitter mechanism situated in an emergency vehicle and adapted to emit an activation signal via free space. Further provided is a receiver mechanism situated within another vehicle and adapted to actuate upon the receipt of the activation signal via free space. An emergency citizen band radio receiver is connected to the receiver mechanism and is adapted to receive emergency instructions from a driver of the emergency vehicle upon the supply of power thereto. To ensure the driver is given proper indication and instruction, the emergency citizen band radio receiver is further adapted to playback a prerecorded warning message upon the supply of power thereto in combination with the lack of receipt of emergency instructions from the driver. Also included is a switch mechanism situated within the receiver housing and coupled to the receiver mechanism and the emergency citizen band radio receiver. The switch mechanism is adapted to preclude the supply of power to the emergency citizen band radio receiver upon the lack of actuation of the receiver mechanism and further allow the supply of power to the emergency citizen band radio receiver upon the actuation of the receiver mechanism.

1 Claim, 3 Drawing Sheets

12
16
14

18
POWER
TRANSMITTER

ANT
ANT
26
RECEIVER
28
SPEAKER
PRERECORDED MSG.
32

EMERGENCY VEHICLE PROXIMITY WARNING AND COMMUNICATION SYSTEM

BACKGROUND OF THE INVENTION

1. Field of the Invention

The present invention relates to an emergency vehicle proximity warning and communication system and more particularly pertains to providing instructions to a driver when in the vicinity of an emergency vehicle and further allowing the emergency vehicle to communicate with the driver.

2. Description of the Prior Art

The use of vehicle proximity warning systems is known in the prior art. More specifically, vehicle proximity warning systems heretofore devised and utilized for the purpose of indicating to a user that an emergency vehicle is near are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,794,394 to Halstead; U.S. Pat. No. 3,949,300 to Salder; U.S. Pat. No. Des. 351,805 to Pagano; U.S. Pat. No. 4,403,208 to Hodgson et al.; U.S. Pat. No. 4,296,496 to Salder; and U.S. Pat. No. 4,443,790 to Bishop are disclosed as being of general interest.

In this respect, the emergency vehicle proximity warning and communication system according to the present invention substantially departs from the conventional concepts and designs of the prior art, and in so doing provides an apparatus primarily developed for the purpose of providing instructions to a driver when in the vicinity of an emergency vehicle and further allowing the emergency vehicle to communicate with the driver.

Therefore, it can be appreciated that there exists a continuing need for a new and improved emergency vehicle proximity warning and communication system which can be used for providing instructions to a driver when in the vicinity of an emergency vehicle and further allowing the emergency vehicle to communicate with the driver. In this regard, the present invention substantially fulfills this need.

SUMMARY OF THE INVENTION

In view of the foregoing disadvantages inherent in the known types of vehicle proximity warning systems now present in the prior art, the present invention provides an improved emergency vehicle proximity warning and communication system. As such, the general purpose of the present invention, which will be described subsequently in greater detail, is to provide a new and improved emergency vehicle proximity warning and communication system which has all the advantages of the prior art and none of the disadvantages.

To attain this, the present invention essentially comprises a transmitter housing with a generally rectangular configuration. The transmitter housing has a top face, a bottom face, and a periphery formed therebetween thus defining an interior space. As shown in FIG. 5, the transmitter housing is situated within a grill of an emergency vehicle. Situated in the transmitter housing is a transmitter mechanism. The transmitter mechanism is coupled to a siren of the emergency vehicle. In use, upon the activation of the siren of the emergency vehicle, the transmitter mechanism is adapted to emit an activation signal about a predetermined distance via free space. For reasons that will be set forth later, the emergency vehicle is further equipped with an emergency citizen band radio. As shown in FIG. 4, a receiver housing is provided having a planar bottom face, a short front face, and a tall rear face. The receiver housing further has a bevelled top face integrally formed between the rear face and the front face. For coupling purposes, a pair of eyelets are integrally formed on opposing side faces in a plane in which the rear face resides. Working in conjunction with the eyelets is an adhesive lining the rear face. Preferably, the receiver housing is situated within a vehicle of a user on the dash board thereof. For providing an indication that an emergency vehicle is in the proximity of the vehicle of the user, a receiver mechanism is situated within the receiver housing. The receiver mechanism is adapted to actuate upon the receipt of the activation signal via free space. To allow a driver of the emergency vehicle to communicate instructions to the user, a emergency citizen band radio receiver is situated within the receiver housing. The emergency citizen band radio receiver is adapted to receive emergency instructions from the driver of the emergency vehicle upon the supply of power thereto. The emergency citizen band radio receiver is further adapted to playback a prerecorded warning message upon the supply of power thereto in combination with the lack of receipt of emergency instructions from the driver. A vehicle radio situated within the vehicle of the user is connected with the present invention. The vehicle radio is coupled to a plurality of standard speakers for emitting radio signals therefrom upon the supply of power thereto. The speakers are further coupled to the emergency citizen band radio receiver for audibly transmitting the emergency instructions and the prerecorded warning message. Finally, a switch mechanism is situated within the receiver housing for actuating the emergency citizen band radio receiver and the vehicle radio under the correct conditions. To accomplish this, the switch mechanism is coupled to the receiver mechanism, emergency citizen band radio receiver, and vehicle radio. In operation, the switch mechanism is adapted to allow the supply of power to the radio and further preclude the supply of power to the emergency citizen band radio receiver upon the lack of actuation of the receiver mechanism. Upon the actuation of the receiver mechanism, the switch mechanism is adapted to preclude the supply of power to the radio and further allow the supply of power to the emergency citizen band radio receiver.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved emergency vehicle proximity warning and communication system which has all the advantages of the prior art vehicle proximity warning systems and none of the disadvantages.

It is another object of the present invention to provide a new and improved emergency vehicle proximity warning and communication system which may be easily and efficiently manufactured and marketed.

It is a further object of the present invention to provide a new and improved emergency vehicle proximity warning and communication system which is of a durable and reliable construction.

An even further object of the present invention is to provide a new and improved emergency vehicle proximity warning and communication system which is susceptible of a low cost of manufacture with regard to both materials and labor, and which accordingly is then susceptible of low prices of sale to the consuming public, thereby making such emergency vehicle proximity warning and communication system economically available to the buying public.

Still yet another object of the present invention is to provide a new and improved emergency vehicle proximity warning and communication system which provides in the apparatuses and methods of the prior art some of the advantages thereof, while simultaneously overcoming some of the disadvantages normally associated therewith.

Still another object of the present invention is to provide instructions to a driver when in the vicinity of an emergency vehicle and further allow the emergency vehicle to communicate with the driver.

Lastly, it is an object of the present invention to provide a new and improved emergency vehicle proximity warning and communication system including a transmitter mechanism situated in an emergency vehicle and adapted to emit an activation signal via free space. Further provided is a receiver mechanism situated within another vehicle and adapted to actuate upon the receipt of the activation signal via free space. An emergency citizen band radio receiver is connected to the receiver mechanism and is adapted to receive emergency instructions from a driver of the emergency vehicle upon the supply of power thereto. To ensure the driver is given proper indication and instruction, the emergency citizen band radio receiver is further adapted to playback a prerecorded warning message upon the supply of power thereto in combination with the lack of receipt of emergency instructions from the driver. Also included is a switch mechanism situated within the receiver housing and coupled to the receiver mechanism and the emergency citizen band radio receiver. The switch mechanism is adapted to preclude the supply of power to the emergency citizen band radio receiver upon the lack of actuation of the receiver mechanism and further allow the supply of power to the emergency citizen band radio receiver upon the actuation of the receiver mechanism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
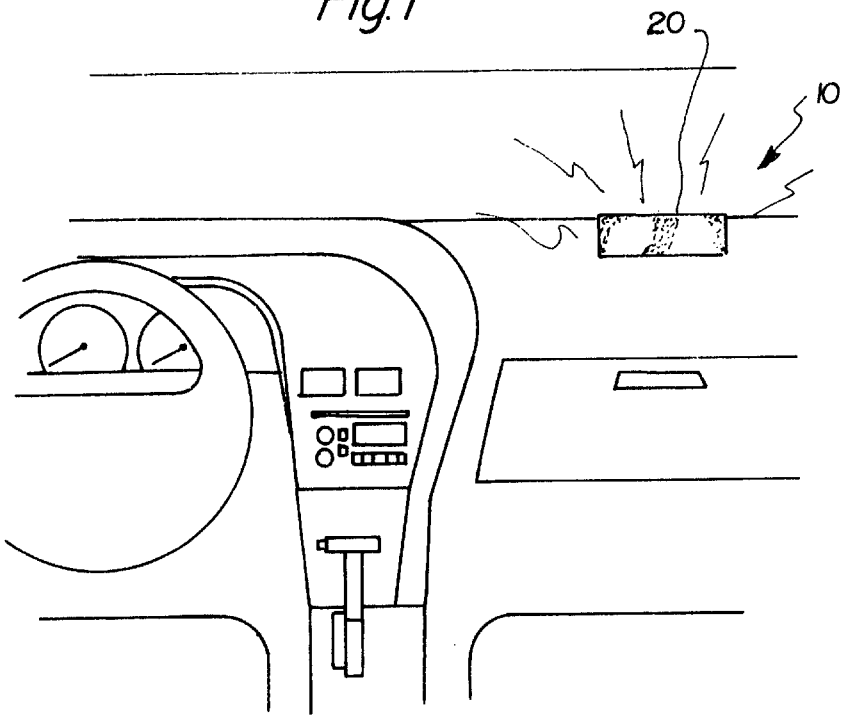
FIG. 1 is an illustration of the preferred embodiment of the emergency vehicle proximity warning and communication system constructed in accordance with the principles of the present invention.

With reference now to the drawings, and in particular to FIG. 1 thereof, a new and improved emergency vehicle proximity warning and communication system embodying the principles and concepts of the present invention and generally designated by the reference numeral 10 will be described.

The present invention, the new and improved emergency vehicle proximity warning and communication system, is comprised of a plurality of components. Such components in their broadest context include a transmitter mechanism, a receiver mechanism, an emergency citizen band radio receiver, a vehicle radio, and a switch mechanism. Such components are individually configured and correlated with respect to each other so as to attain the desired objective.

Figure 5:
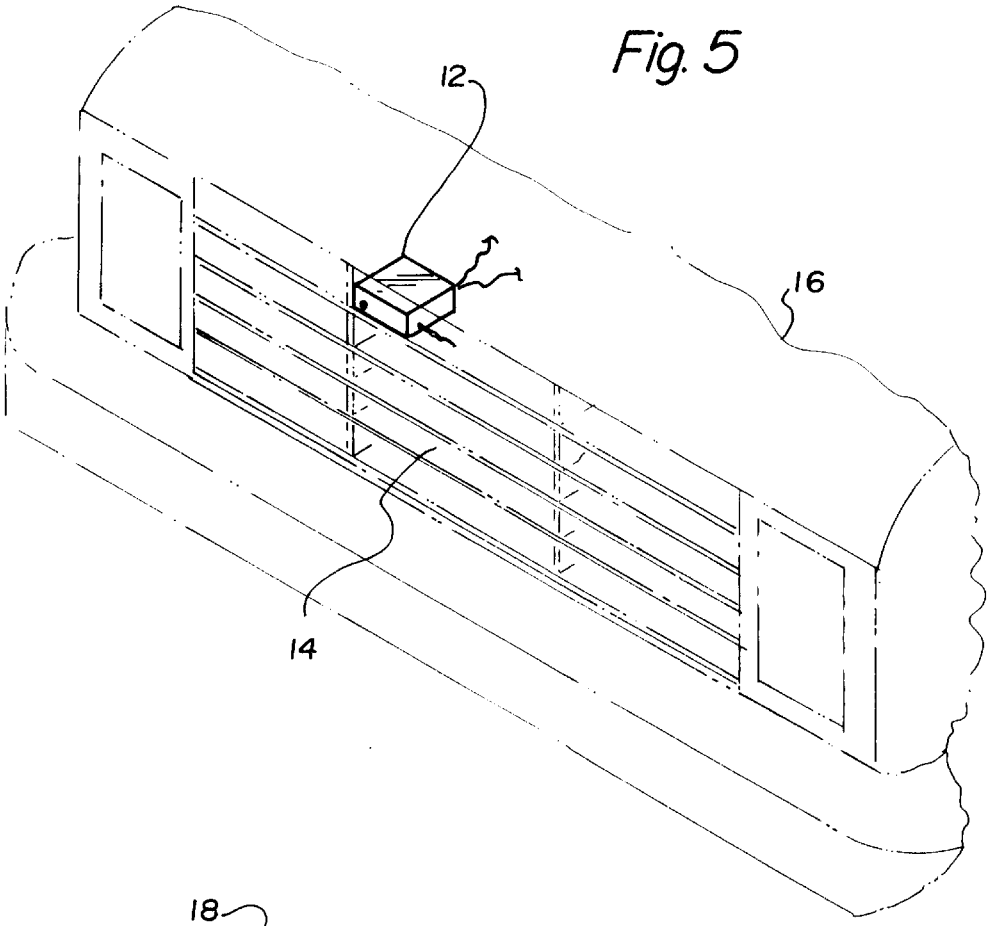
FIG. 5 is a perspective view of the transmitter housing in its operative orientation.
Figure 6:
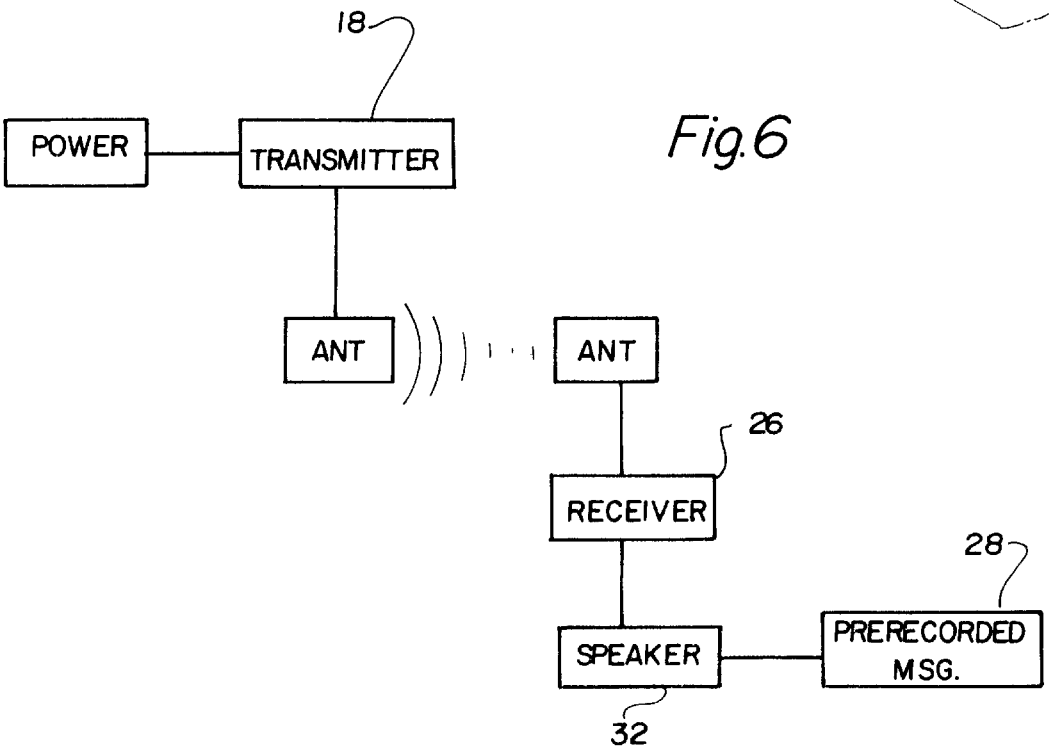
FIG. 6 is a general block diagram depicting the interaction between the transmitter and receiver.

More specifically, it will be noted that the system 10 of the present invention includes a transmitter housing 12 with a generally rectangular configuration. The transmitter housing has a top face, a bottom face, and a periphery formed therebetween thus defining an interior space. As shown in FIG. 5, the transmitter housing is situated within a grill 14 of an emergency vehicle 16. Ideally, the transmitter housing is constructed from a durable plastic. For reasons that will be set forth later, the emergency vehicle is further equipped with an emergency citizen band radio.

Situated in the transmitter housing is a transmitter mechanism 18. The transmitter mechanism is coupled to a siren of the emergency vehicle. In use, upon the activation of the siren of the vehicle, the transmitter mechanism is adapted to emit an activation signal about a predetermined distance via free space.

Figure 4:
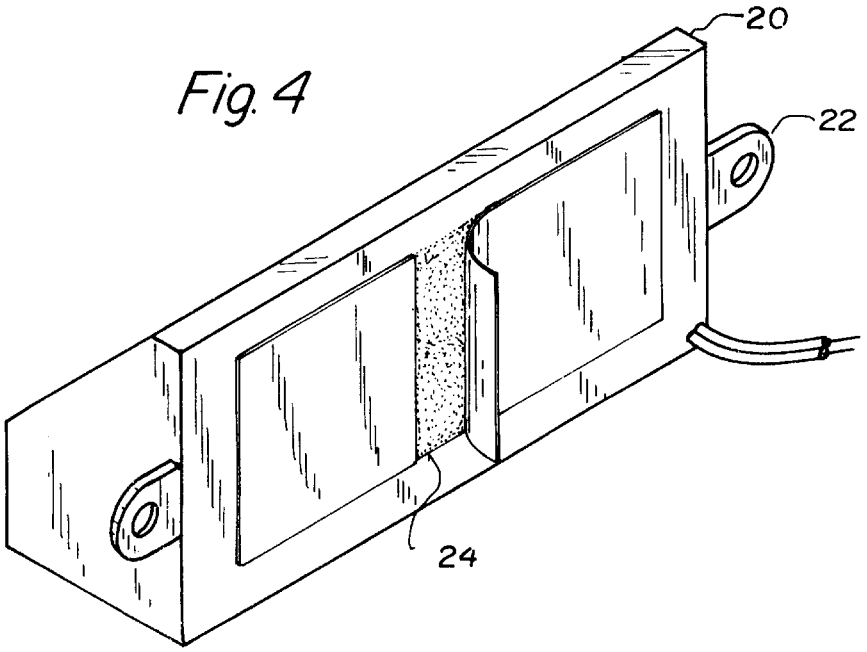
FIG. 4 is another perspective view of the receiver housing as shown in FIG. 3.

As shown in FIG. 4, a receiver housing 20 is provided having a planar bottom face, a short front face, and a tall rear face. The receiver housing further has a bevelled top face integrally formed between the rear face and the front face. The top face has a cloth mesh portion for allowing sound to travel therethrough. For mounting purposes, a pair of eyelets 22 are integrally formed on opposing side faces of the receiver housing in a plane in which the rear face resides. Working in conjunction with the eyelets is an adhesive 24 lining the rear. Preferably, the receiver housing is situated within a vehicle of the user on the dash board thereof.

For providing an indication that an emergency vehicle is in the proximity of the vehicle of the user, a receiver mechanism 26 is situated within the receiver housing. The receiver mechanism is adapted to actuate upon the receipt of the activation signal via free space.

To allow a driver of the emergency vehicle to communicate instructions to the user, a emergency citizen band radio receiver 28 is situated within the receiver housing. The emergency citizen band radio receiver is adapted to receive emergency instructions from the driver of the emergency vehicle upon the supply of power thereto. Preferably, the emergency citizen band radio is permanently tuned to channel "9" of the citizen frequency band. As such, the driver of the emergency vehicle is merely required to utilize a conventional citizen band radio transceiver to instruct another driver. The emergency citizen band radio receiver is further adapted to playback a prerecorded warning message contained therein upon the supply of power thereto in combination with the lack of receipt of emergency instructions from the driver of the emergency vehicle. The warning message preferably states the following: "An emergency vehicle is approaching. Please use caution while pulling to the right lane."

A vehicle radio 30 situated within the vehicle of the user is connected with the present invention. The vehicle radio is coupled to a plurality of standard speakers 32 for emitting radio signals therefrom upon the supply of power thereto. The speakers are further coupled to the emergency citizen band radio receiver for audibly transmitting the emergency instructions and the prerecorded warning message. It should be noted that, as an option, an additional speaker may be included within the receiver housing so as to require coupling of components of the receiver housing with solely the vehicle radio and a power source. In such an embodiment, the additional speaker is situated adjacent the mesh portion of the receiver housing.

Finally, a switch mechanism 34 is situated within the receiver housing for actuating the emergency citizen band radio receiver and the vehicle radio under the correct conditions. To accomplish this, the switch mechanism is coupled to the receiver mechanism, emergency citizen band radio receiver, and vehicle radio. In operation, the switch mechanism is adapted to allow the supply of power to the radio and further preclude the supply of power to the emergency citizen band radio receiver upon the lack of actuation of the receiver mechanism. Upon the actuation of the receiver mechanism, the switch mechanism is adapted to preclude the supply of power to the radio and further allow the supply of power to the emergency citizen band radio receiver.

Figure 2:
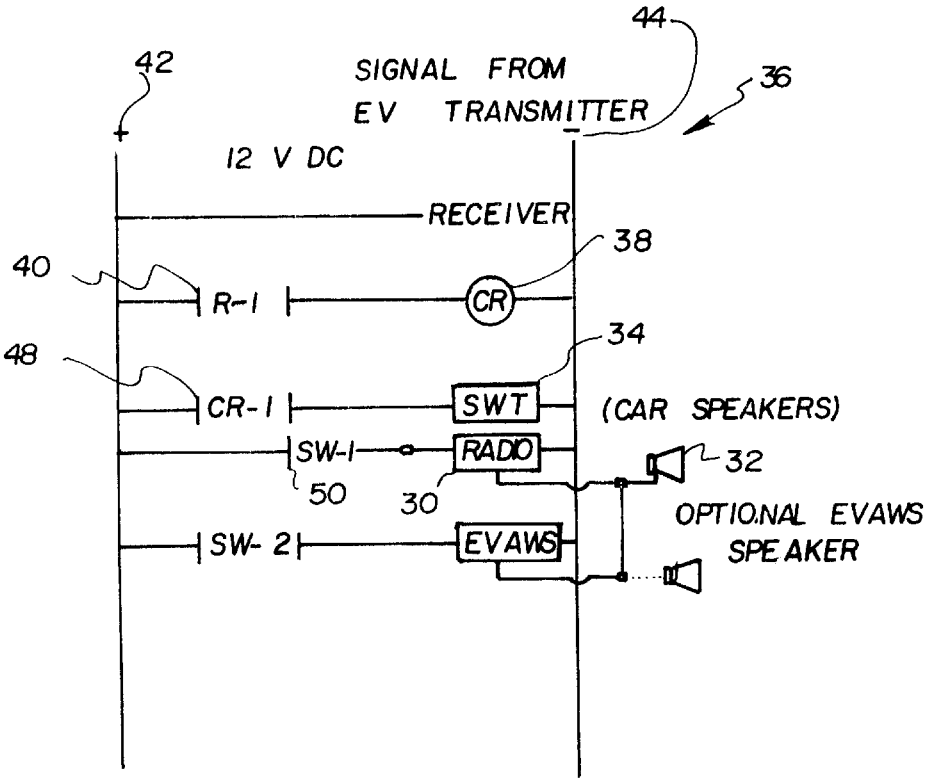
FIG. 2 is a schematic diagram depicting the circuitry involved with the present invention.
Figure 3:
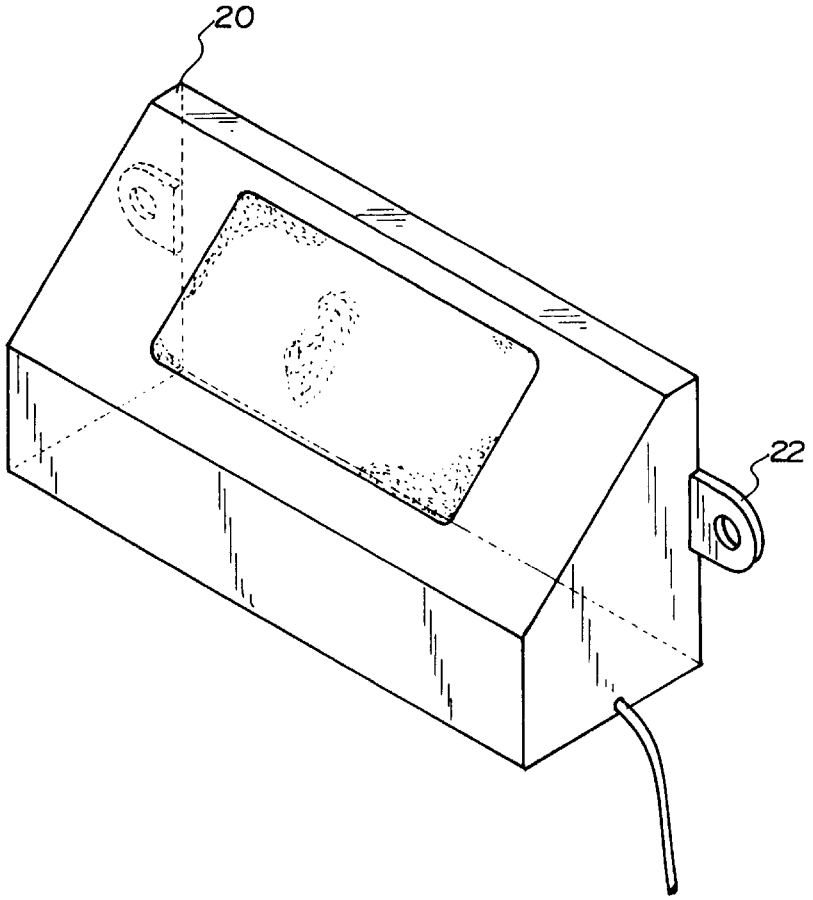
FIG. 3 is a perspective view of the receiver housing of the present invention.

As shown in FIG. 2, circuitry 36 is provided for affording proper operation of the foregoing components. Such circuitry ideally resides within the receiver housing. A first relay coil 38 and a receiver relay contact 40 are coupled between a positive terminal 42 and negative terminal 44 of a battery of the vehicle of the user. The first relay coil and receiver relay contact combination are coupled in parallel with the receiver mechanism, whereby the receiver relay contact has an closed orientation only upon the actuation of the receiver. Further provided is a first relay contact 48 connected in series with the switch mechanism. The combination of the first relay contact and the switch mechanism is also coupled in parallel with the receiver. The first relay contact has a closed orientation only upon the energization of the first relay coil which is actuated by the closing of the receiver relay contact. Connected in series with the radio is a first switch relay contact 50 which closes only when the switch mechanism is not in receipt of power which is afforded by the lack of receipt of the activation signal by the receiver. It should be noted that the combination of the radio and first switch relay contact is coupled in parallel with the receiver. A second switch relay contact 52 is connected in series with the emergency citizen band radio receiver between the positive and negative terminal of the battery. The second switch relay contact is adapted to close only upon the receipt of power by the switch mechanism. As such, by the above structure, the radio is only supplied power upon the lack of receipt of the activation signal by the receiver and the emergency citizen band radio receiver is only supplied power upon the receipt of the activation signal by the receiver.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved emergency vehicle proximity warning and communication system comprising, in combination:

a transmitter housing with a generally rectangular configuration having a top face, a bottom face, and a periphery formed therebetween, wherein the transmitter housing is situated within a grill of an emergency vehicle, wherein the emergency vehicle is equipped with an emergency citizen band radio;

transmitter means situated within the transmitter housing and coupled to a siren of the emergency vehicle, the transmitter means adapted to emit an activation signal a predetermined distance via free space upon the activation of the siren of the vehicle;

a receiver housing having a planar bottom face, a short front face, and a tall rear face, the receiver housing further having a bevelled top face integrally formed between the rear face and the front face and a pair of eyelets integrally formed on opposing side faces in a plane in which the rear face resides, the rear face having an adhesive lining formed thereon, wherein the receiver housing is situated within a vehicle of a user;

receiver means situated within the receiver housing and adapted to actuate upon the receipt of the activation signal via free space;

an emergency citizen band radio receiver situated within the receiver housing, the emergency citizen band radio receiver adapted to receive emergency instructions from a driver of the emergency vehicle upon the supply of power thereto, the emergency citizen band radio receiver housing further adapted to playback a prerecorded warning message upon the supply of power thereto in combination with the lack of receipt of emergency instructions from the driver;

a vehicle radio situated within the vehicle of the user, the vehicle radio connected to a plurality of speakers for emitting radio signals therefrom upon the supply of power thereto, wherein the speakers are further coupled to the emergency citizen band radio receiver for audibly transmitting the emergency instructions and the prerecorded warning message upon the receipt thereof;

switch means situated within the receiver housing and coupled to the receiver means, emergency citizen band radio receiver, and vehicle radio, the switch means adapted to allow the supply of power to the radio and further preclude the supply of power to the emergency citizen band radio receiver upon the lack of actuation of the receiver means and the switch means also adapted to preclude the supply of power to the radio and further allow the supply of power to the emergency citizen band radio receiver upon the actuation of the receiver means; and circuitry including a first relay coil and a receiver relay contact coupled between a positive terminal and a negative terminal of a battery, the first relay coil and receiver relay contact are coupled in parallel with the receiver means, the receiver relay contact having an closed orientation only upon the actuation of the receiver means, the circuitry further including a first relay contact connected in series with the switch means, the first relay contact and the switch means also coupled in parallel with the receiver means, the first relay contact having a closed orientation only upon the energization of the first relay coil which is actuated by the closing of the receiver relay contact, the circuitry further including a first switch relay contact connected in series with the radio which closes only when the switch means is not in receipt of power which is afforded by the lack of receipt of the activation signal by the receiver means and a second switch relay contact connected in series with the emergency citizen band radio receiver between the positive and negative terminal of the battery the second switch relay contact adapted to close only upon the receipt of power by the switch means, whereby the radio is only supplied power upon the lack of receipt of the activation signal by the receiver means and the emergency citizen band radio receiver is only supplied power upon the receipt of the activation signal by the receiver means.

* * * * *